US006051297A

United States Patent [19]

Maier et al.

[11] Patent Number: 6,051,297

[45] Date of Patent: Apr. 18, 2000

[54] SELF-CONTRASTING RETROREFLECTIVE PAVEMENT MARKING TAPES

[75] Inventors: Gary William Maier, Roberts, Wis.; Eric Edward Rice, Woodbury, Minn.

[73] Assignee: 3M Innovative Properties Company, St. Paul, Minn.

[21] Appl. No.: 08/895,482

[22] Filed: Jul. 16, 1997

[51] Int. Cl.[7] ..... B32B 3/14

[52] U.S. Cl. ..... 428/56; 427/136; 427/163.4; 427/208.2; 427/208.4; 427/261; 428/332; 428/413; 428/423.1; 428/522; 428/523

[58] Field of Search ..... 427/136, 208.2, 427/208.4, 261, 163.4; 428/332, 56, 413, 423.1, 522, 523

[56] References Cited

U.S. PATENT DOCUMENTS

| | | | |
|---|---|---|---|
| 3,399,607 | 9/1968 | Eigenmann . | |
| 4,386,998 | 6/1983 | McIntyre et al. | 156/473 |
| 4,391,856 | 7/1983 | McIntyre et al. | 427/358 |
| 4,575,278 | 3/1986 | Whitney | 404/72 |
| 4,988,541 | 1/1991 | Hedblom | 427/163 |
| 5,124,178 | 6/1992 | Haenggi et al. | 427/204 |
| 5,223,312 | 6/1993 | Langille | 428/31 |

FOREIGN PATENT DOCUMENTS

| | | | |
|---|---|---|---|
| 0 162 229 | 11/1985 | European Pat. Off. . | |
| 0 346 021 | 12/1989 | European Pat. Off. . | |
| 0 453 135 | 10/1991 | European Pat. Off. . | |
| 0 683 268 A2 | 11/1995 | European Pat. Off. | E01F 9/04 |
| 1 459 813 | 11/1968 | Germany . | |
| WO 95/08426 | 3/1995 | WIPO . | |
| WO 97/18947 | 5/1997 | WIPO | B32B 28/08 |

*Primary Examiner*—Bernard Pianalto
*Attorney, Agent, or Firm*—Lisa M. Fagan

[57] ABSTRACT

Retroreflective articles of the invention comprise a continuous base layer and a multi-color polymeric top layer. The invention also includes methods of making such retroreflective articles. The retroreflective articles of the invention provide excellent daytime contrast while maintaining nighttime retroreflectivity. Variously colored segments of polymer are directly and either sequentially or simultaneously coated onto a continuous backing to form a multi-colored top layer. Durability over existing multi-colored retroreflective articles is enhanced by use of a continuous base layer.

19 Claims, 1 Drawing Sheet

SELF-CONTRASTING RETROREFLECTIVE PAVEMENT MARKING TAPES

FIELD OF INVENTION

The present invention relates to pavement markings having a multi-colored top layer and a continuous base layer which provide excellent daytime contrast while maintaining nighttime retroreflectivity, and methods for making such markings.

BACKGROUND OF THE INVENTION

Preformed pavement marking materials (sometimes known as pavement marking tapes), such as short or long distance lane striping, stop bars, and pedestrian lane markings at intersections are used as traffic control markings to guide travelers using roadways or other traffic-bearing surfaces. Typically, preformed pavement marking materials comprise a wear-resistant top layer overlying a conformable base layer and an adhesive layer (e.g., a pressure-sensitive adhesive or contact cement).

Generally, pavement marking tapes are white, yellow, or black. The yellow and white pavement marking tapes provide contrast with the roadway (or traffic-bearing surface) material. Black pavement marking tapes are typically useful in construction zones to cover existing yellow or white markings.

Although the yellow and white pavement marking tapes generally have good daytime visibility or conspicuity, there are roadway materials and regions of the country where the visibility of these markings can be enhanced. White pavement marking tapes may readily "blend" with the roadway color, negatively affecting visibility. For example, white pavement markings on concrete roadways tend to blend with the roadway color. In the southern part of the United States (e.g., Florida), the asphalt roadway surface "bleaches" after prolonged exposure to the sun. Here, white pavement marking tapes may "blend" with the asphalt roadway color.

One method of enhancing daytime visibility is to place a contrasting color (such as black) longitudinally between the white or yellow skip-lines.

A second method involves placing a contrasting color (e.g., black) alongside the white or yellow pavement marking tape to form a composite. Composite pavement marking tapes comprising strips of a pavement marking material of one color longitudinally spliced together with strips of a pavement marking material of a second color to form a multi-colored pavement marking tape are currently available commercially. One such self-contrasting pavement marking tape is a black and white tape, 380-5 Stamark™ Contrast Tape, available from Minnesota Mining and Manufacturing Company ("3M"), St. Paul, Minn. In a composite pavement marking tape construction, each single color pavement marking tape is separately coated onto a backing and slit to the desired width of the strip, or "zone." The pavement marking strips of various colors are then spliced together, typically with filament tape, to form the composite multi-colored pavement marking tape.

The current available multi-colored pavement marking tapes require first coating and slitting each color strip of pavement marking tape, and then splicing the three strips together. This manufacturing process is labor intensive and time consuming, and therefore costly. Additionally, pavement marking tapes made by this manufacturing process are susceptible to coming apart at the splice region and/or loosening from the pavement at the splice region. These tapes independently perform and weather on each side of the splice as three separate products. These durability deficiencies are particularly problematic in high traffic skip areas.

The need exists for multi-colored retroreflective articles such as pavement marking tapes, which exhibit greater durability and greater ease of manufacture. Such multi-colored pavement markings preferably provide excellent daytime contrast while maintaining nighttime retroreflectivity.

SUMMARY OF THE INVENTION

The present invention provides multi-colored retroreflective pavement marking tapes which provide excellent daytime contrast and therefore excellent conspicuity, while maintaining nighttime retroreflectivity. The multi-colored pavement marking tapes of the invention have a continuous base layer, and thus exhibit increased durability and uniform performance when compared to pavement marking tapes without such a continuous base layer. The multi-colored pavement marking tapes of the present invention are easier and less costly to manufacture than currently available contrast pavement marking tapes. The tapes of the present invention may be substantially flat or patterned and durable or removable.

In brief summary, retroreflective tapes of the present invention comprise a continuous base layer and a multi-colored top layer which is self-contrasting. Typically, optical elements and/or skid-resistant particles are partially embedded in and protrude from the top layer. The base layer is continuous and capable of supporting the entire tape. The self-contrasting top layer comprises a plurality of variously colored linear segments oriented substantially parallel to the longitudinal axis of the pavement marking tape. The adjacent sides of the colored linear segments are very close to one another, if not actually in contact. In some embodiments, the top layer is substantially continuous with different colored linear segments. Each of the colored linear segments is considered to be a "zone" for the purposes of this invention. Each linear segment may comprise a plurality of narrower regions. Each zone may be comprised of a different composition. In addition, each zone may comprise two or more compositions.

The overall tape construction may vary depending on the desired use for the product (e.g., longline durable tape, longline removable tape, and intersection tape). In addition, the retroreflective articles of the invention may be made into the desired form, e.g., as tapes in roll form, or sheets, with or without an adhesive for securing to a traffic-bearing surface.

The retroreflective tapes of the present invention provide performance advantages as well as fabrication advantages. The contrast between the two or more colors of the top layer provides increased conspicuity, while the continuous nature of the base layer provides increased durability of the retroreflective article. Increased durability, as demonstrated by the improved adhesion of the pavement marking tape to traffic-bearing surfaces, increases the useful life of such pavement marking tapes.

The method of fabrication of the retroreflective articles of the invention, e.g., directly and simultaneously coating multiple colors onto a continuous backing, is less labor intensive and less time consuming; and therefore, less costly than previously known methods of fabricating multi-colored retroreflective articles.

BRIEF DESCRIPTION OF THE DRAWING

The invention will be more fully explained with reference to the following drawings in which.

These figures, which are idealized, are not to scale and are intended to be merely illustrative and non-limiting.

DESCRIPTION OF ILLUSTRATIVE EMBODIMENTS

The present invention provides retroreflective articles having two or more different colors to provide contrast so as to be readily visible both during the day as well as at night. Multi-colored retroreflective articles such as pavement marking tapes are particularly useful when contrast between the road marking and the road surface is needed, such as white pavement markings on a concrete road.

Retroreflective articles of the present invention typically comprise, in order, a multi-colored self-contrasting top layer, generally having optional optical elements and/or optional skid-resistant particles protruding from the top surface thereof, a continuous base layer, and typically an optional adhesive layer. As mentioned above, the multi-colored polymeric top layer comprises a plurality of colored linear segments (or zones) oriented substantially parallel to the longitudinal axis (i.e., downweb striping) of the pavement marking tape. The adjacent sides of each colored linear segment are very close to one another, if not actually in contact, so that the top layer appears to be continuous.

Figure 1:
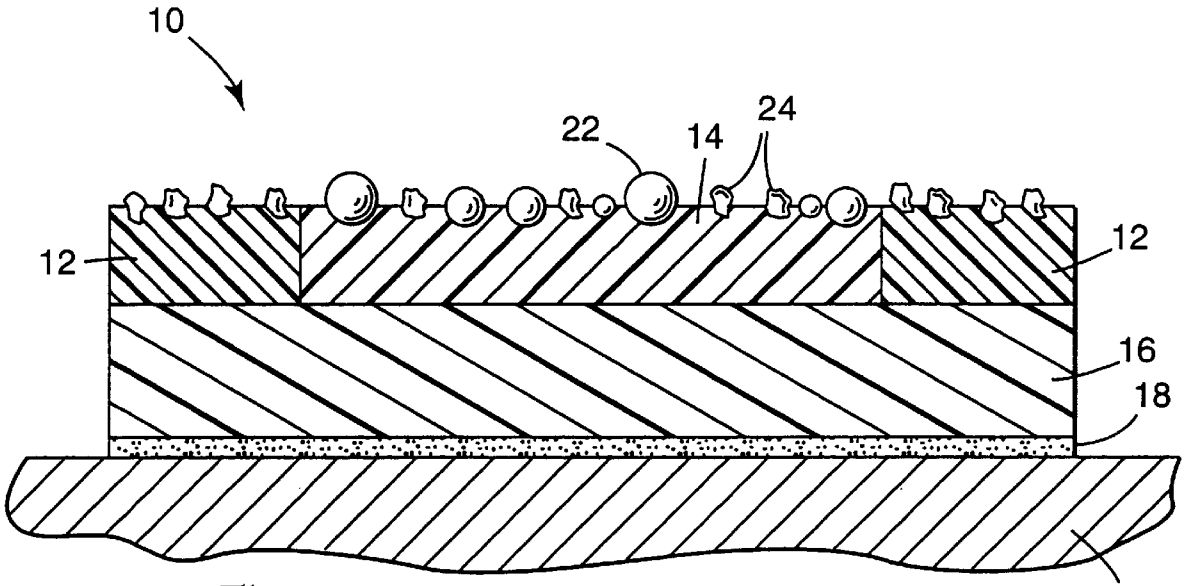
FIG. 1 is a cross-sectional view of an illustrative pavement marking of the invention on the surface of pavement.

An illustrative retroreflective article of the present invention is shown in cross-section in FIG. 1. Pavement marking 10 comprises a top layer with optional optical elements 22 and optional skid-resistant particles 24 protruding from the top surface thereof, base layer 16, and optional adhesive layer 18 on pavement surface 20 of a traffic-bearing surface. The top layer comprises segment or zone 14 of a first color and segments or zones 12 of a second color.

Figure 2:
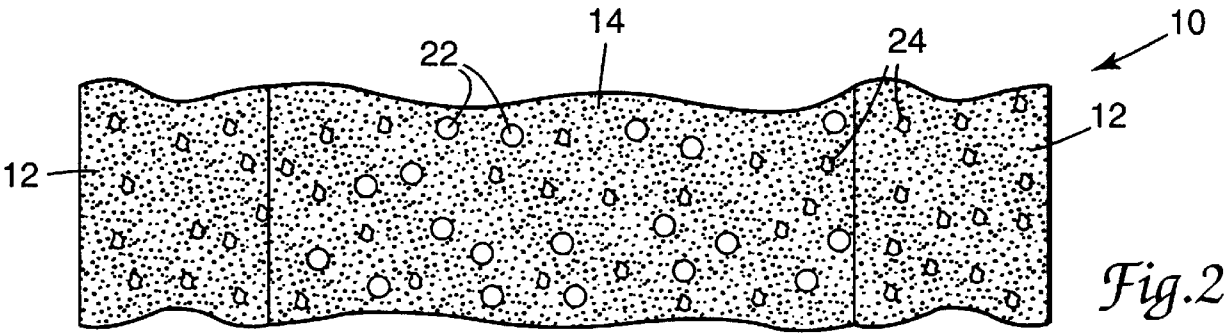
FIG. 2 is a plan view of the top surface of an illustrative pavement marking of the invention.

A plan view of an illustrative pavement marking of the present invention is shown in FIG. 2. Zone 14 is typically a first color, while contrast zones 12 are a second color.

Top Layer

The top layer is typically comprised of durable and wear-resistant material and generally provides the desired conspicuity and message-bearing function (e.g., color coding). Optical elements (e.g., glass or ceramic microspheres) and/or skid-resistant (i.e., traction promotive) particles typically are partially embedded in and protrude from the top surface of the top layer. Generally, skid-resistant particles are partially embedded across each zone of the top layer. Optical elements may be partially embedded in the conspicuity zone or across each zone of the top layer.

The top layer is the layer or layers over the base layer. The top layer material is formulated to attain the desired functional properties, such as retroreflectivity, weatherability, ability to hold skid-resistant particles and optical elements, and durability, while still remaining coatable. Suitable top layer materials should be coatable, curable, and able to accept colorant (e.g., pigment or dye).

The top layer may be comprised of, for example, polyurethane, polyvinyl chloride (PVC), polyvinyl acetate (PVA), PVC/PVA blends, ethyl/methyl methacrylate copolymers, epoxies, polyethylene-co-acrylic acid (EAA), melamine resins, and polyamides. Each zone may be comprised of a different composition.

Preferably, the top layer comprises polyurethane. For example, the urethane top layers disclosed in U.S. Pat. No. 5,077,117 (Harper et al.), herein incorporated by reference in its entirety, are suitable. When substantially cured, suitable urethanes have a modulus ranging from about 10,000 to about 200,000 psi ($6.9\times10^7$ to $1.4\times10^9$ Pa), preferably from about 45,000 to about 60,000 psi ($3.1\times10^8$ to $4.1\times10^8$ Pa). These cured urethanes have an elongation ranging from about 2% to about 100%, preferably from about 20% to about 30%. Additionally, these cured urethanes have a peak stress ranging from about 500 to about 5000 psi ($3.4\times10^6$ to $3.4\times10^7$ Pa), preferably from about 1500 to about 1900 psi ($1.0\times10^7$ to $1.3\times10^7$ Pa).

The application method defines the appropriate viscosity and percent solids.

The top layer is generally between about 100 and about 1500 microns (4 and 60 mils) thick, preferably about 150 to about 180 microns (6 to 7 mils) thick. The thickness of the top layer is determined in part by the optical element or skid-resistant particle size.

The top layer may be a single layer or a multi-layer construction. For example, the top layer may comprise a first layer with optical elements and/or skid-resistant particles protruding therefrom and an underlying secondary layer.

To extend the life of the pavement marking, the secondary layer may also be colored as desired and contain embedded optical elements and/or skid-resistant particles. Illustrative examples include pavement marking tape having a white secondary layer and a white and black first layer and pavement marking tape having a white and black secondary layer and a white and black first layer.

Each segment or zone may have a different color. The most typical pavement marking tapes of the present invention have a central zone of main color for conspicuity. Generally this central zone is white, yellow or orange. The zones of color or colors selected to contrast with this conspicuity zone are referred to as "contrast zones." The contrast zone, which serves to make the conspicuity zone more conspicuous, is typically narrower than the conspicuity zone. Generally, the conspicuity zone is about two to three times wider than the contrast zone. For example, the conspicuity zone is typically at least about 2 inches (about 5 cm) wide, and generally ranges from about 2 to about 8 inches (about 5 to about 20 cm) wide and each contrast zone may have a width ranging from about 0.75 to about 2.0 inches (about 1.9 to about 5 cm).

Each zone may be comprised of a subset of narrower regions which are oriented substantially parallel to the longitudinal axis of the tape. Moreover, there may be more than one composition within each zone. For example, the conspicuity zone may be comprised of narrower regions having alternating compositions. The different compositions within a zone may or may not have the same color.

The conspicuity zone and the contrast zone are adjacent to each other and substantially parallel to the longitudinal axis of the pavement marking tape. The zones of the top layer are very close to one another so that the top layer appears to be a continuous coating. Preferably, the zones do not overlap.

The contrast zone's color is selected to contrast with the conspicuity zone's color. For example, black contrast zones on either side of a white or yellow conspicuity zone. Any of a wide variety of colorants, e.g., pigments and dyes, may be used to impart color to each zone of the pavement marking tape. Generally, the pigment or die is distributed substantially uniformly throughout the top layer. Moreover, narrower regions within a zone may have differing color. Examples of suitable pigments include, but are not limited to Carbon Black CI 77266 Pigment Black 7 (Ashland Oil, Carbon Black Division, Houston, Tex.), Titanium Dioxide CI 77891 Pigment White 6 (DuPont, Wilmington, Del.), Chrome Yellow CI 77603 Pigment Yellow 34 (Cookson, Pigments, Newark, N.J.), Arylide Yellow CI 11741 Pigment Yellow 74 (Hoechst Celanese, Charlotte, N.C.), Arylide Yellow CI 11740 Pigment Yellow 65 (Hoechst Celanese, Charlotte, N.C.), and Diarylide Yellow HR CI 21108 Pigment Yellow 83 (Hoechst Celanese, Charlotte, N.C.).

A variety of suitable optical elements and skid-resistant particles are well known to those skilled in the art. Illustrative examples of optical elements include ceramic and glass microspheres, sometimes having hemispheric reflectors thereon or with pigment particles in the top layer. Illustrative examples of optical elements include those discussed in U.S. Pat. Nos. 4,564,556 and 4,758,469, which are incorporated by reference herein. Illustrative examples of skid-resistant particles include those disclosed in U.S. Pat. Nos. 5,124,178, 5,094,902, 4,937,127, and 5,053,253.

Each zone may have a different density or type of optical element and/or skid-resistant particle. Alternatively, each zone may have the same density and type of optical element and/or skid-resistant particles, where the only difference between the zones is the color or composition.

Base Layer

The multi-colored pavement marking tapes of the present invention comprise a continuous base layer. This improved contiguity provides performance advantages over currently available multi-colored composite pavement marking tapes which have longitudinally spliced strips of variously colored pavement marking tape. These composite tapes are susceptible to coming apart and/or loosening from the pavement particularly at the splice and in high traffic skip areas. Each spliced section of these tapes behaves as an independent article. Because pavement marking tapes of the present invention have a continuous base layer, and therefore, have greater structural integrity, they tend to last longer on the roadway surface without coming apart or loosening from the surface. In addition, the tapes of the present invention tend to wear more uniformly increasing the useful life of the tape. This improved durability results in a longer useful life of such pavement marking tapes.

The base layer typically is conformable and is beneath the top layer and above an optional adhesive layer. The base layer may be substantially flat or may have protrusions. The materials which comprise the base layer are selected to achieve desired physical properties such as appropriate tensile strength, elongation, and conformability.

Suitable base layer materials include, but are not limited to, acrylonitrile butadiene rubber, natural rubber, neoprene, polyacrylates, aluminum foil, and styrene-butadiene rubber. See, for example, U.S. Pat. Nos. 4,490,432; 5,422,162; 3,782,843; 3,935,365; 3,399,607; 4,020,211; 4,117,192; and 4,990,024.

If desired, a fibrous web (i.e., a scrim) may be incorporated into the tape as part of the base layer. The scrim preferably is stretchable and substantially inelastic (i.e., exhibits a low residual force toward recovery of its initial dimensions after being stretched).

The scrim preferably has sufficient tensile strength to support the other elements of the base layer and the pavement marking throughout fabrication, conversion, application to a pavement surface, and where desired, removal from the pavement.

Scrims made of polyester materials are typically preferable for use with urethane-based top layers because such scrims typically exhibit high adhesion to such materials and are also typically quite durable.

The scrim is typically between about 50 and about 500 microns (2 and 20 mils) thick, preferably about 100 to 125 microns (4 to 5 mils). Suitable weight of the scrim will depend in part upon the nature of the fibers. Suitable size of the fibers will depend in part upon the arrangement, e.g., weave or pattern, of the fibers, but typically scrims will be made up of fibers having a denier of below about 5 (0.006 grams/meter) and will have a weight of between about 0.5 and about 5 ounces/yard$^2$ (17 to 170 g/m$^2$). Preferably the scrim is sufficiently porous such that the portion of the top layer in contact therewith (i.e., the bottom portion of the first layer in a single layer top layer or the bottom portion of a secondary layer in a multi-layer top layer) will penetrate the upper regions of the scrim to achieve good contact with the tie layer material which is impregnated in the bottom portions of the scrim layer.

A preferred base layer for greater durability and greater conformability comprises, in order, an extensible fibrous scrim, a tie layer, and a conformance layer wherein the tie layer material impregnates the lower portion of the scrim and material of the top layer impregnates the upper portion of the scrim.

The tie layer is comprised of a resinous material and serves to securely bond the scrim to the conformance layer. Accordingly, a material that provides a strong adhesive bond to both the scrim material and the conformance layer is preferred. The tie layer material preferably is capable of being processed so as to impregnate into the bottom portion of the scrim matrix. Preferably, the tie layer material will impregnate through the scrim material so as to contact the material of the top layer that impregnates into the top portion of the scrim, and in such instances preferably provides a strong bond thereto. The tie layer material preferably exhibits sufficient bond strength to the scrim conformance layer, and top layer such that the various interfaces withstand the shear forces encountered during conversion, application, and use of the base layers and pavement marking tapes of the present invention. An illustrative example of a suitable tie layer material is polybutadiene resin-based pressure-sensitive adhesive.

The tie layer preferably is thick enough to securely bond the scrim to the conformance layer and penetrate into the scrim without covering the upper portions of the scrim. Preferably the tie layer separates the scrim and conformance layer such that the scrim is not in direct contact with the conformance layer.

The conformance layer of the preferred embodiment is typically an aluminum foil between about 50 and about 125 microns (2 and 5 mils) thick. Thinner foils may tend to readily wrinkle, whereas thicker foils tend to cost more and result in less conformable resultant products. The foil preferably has a dull or matte finish on both sides and is preferably substantially free of surface oils and other contaminants that might interfere with adhesion to the foil. Suitable foils, sometimes referred to as dead soft aluminum, are readily selected by those skilled in the art. Other illustrative examples of materials suitable as conformance layers herein include certain extruded films, e.g., rubber, certain thermoplastic polymers, etc., that are known to those skilled in the art. Although proper adhesion to the tie layer and to the underlying adhesive layer are more readily attainable with these materials, typically these materials are more expensive than suitable aluminum foils.

Adhesive Layer

The pavement marking tape may optionally comprise an adhesive layer to adhere the pavement marking tape to the roadway. Preferably, such a layer is a pressure-sensitive adhesive, a contact cement or a heat-activated adhesive. Illustrative examples include natural rubber and hydrocarbon-based adhesives.

Methods of Making

Various coating methods are suitable for making the retroreflective pavement marking tapes of the present invention. For example, suitable methods include a double slot-fed knife coater, a notch-bar coater, a rotating screen printer, a co-extrusion die, a multi-slot fluid-bearing die, a knife-over-roll, and a knife-over-bed coater.

The tapes of the present invention may be coated simultaneously or sequentially. Generally, the pavement marking tapes of the present invention may be fabricated by coating a plurality of colored linear zones parallel to the longitudinal axis of the base layer.

Retroreflective articles of the invention are easier and less costly to manufacture than currently available multi-colored pavement markings. The currently available multi-colored pavement marking tapes require separate coating and slitting of tape constructions of single colors, followed by splicing. As discussed, the manufacturing processes of these currently available multi-colored composite pavement marking tapes are labor intensive and time consuming, and thus costly. The method of fabrication of the retroreflective pavement marking tapes of the present invention, e.g., directly and simultaneously or sequentially coating multiple colors onto a continuous backing, is less labor intensive and time consuming and therefore less costly.

A knife coater and notch-bar coater typically have a roll or a plate to support the web under the knife or notch-bar. The knife or the notch-bar removes the excess coating which is deposited prior to contacting the knife or notch-bar. The gap between the roll or the plate and the knife or the notch-bar controls the amount of coating deposited on the backing. A knife coater or a notch-bar coater may be used to either simultaneously or sequentially fabricate the tapes of the present invention.

Die coating encompasses a variety of coating methods including slot fed knife, extrusion, and fluid-bearing die coating.

Slot fed knife coating typically has an internal manifold or cavity to distribute the fluid to a precision internal channel or slot. As the fluid exits the die through this channel, the die face, which may have various shapes and lengths, is used to achieve the desired coating appearance as well as to aid in controlling the fluid thickness. The distance of the die face to the web may be adjusted to achieve a variety of coating thicknesses. Additional knives or notch-bars may be placed behind the first knife or notch-bar for sequential coating. Multiple slots or channels may be combined in a simultaneous or sequential orientation to make the tapes of the present invention.

Extrusion coating is similar to slot coating except the fluid being coated often has a higher viscosity. Both slot coating and extrusion coating can have pressure-feeding of the fluid through the slot or channel. As with slot die coating, multiple fluid distribution manifolds feeding multiple channels may be oriented such that the different zones of color may be co-extruded (simultaneously coated) or sequentially coated (e.g., adding subsequent extruders).

A fluid bearing die is similar to slot fed coating except the fluid is applied onto a backing which is supported on either side of the die with idler rolls instead of using a precision back-up roll. The fluid is applied to the backing in a free span area. The backing and web tension uniformity can affect the quality of the coating.

A rotating screen printer may be used to make the tapes of the present invention. Two screen printers (one having the contrast color and one having the conspicuity color) can be sequentially oriented. The composition is fed internally into the cylinder. The cylinder rotates and pressure is applied to a doctor blade which forces fluid through the cylinder mesh to the substrate. Typically, either the conspicuity or contrast segment(s) is first coated onto the tape and then the tape proceeds to the second cylinder for the other segment(s) to be coated.

A suitable multiple orifice die for applying a single coating is described in U.S. Pat. No. 4,386,998 (McIntyre et al.) and U.S. Pat. No. 4,391,856 (McIntyre et al.). These patents disclose an apparatus including a defined die system and a method of applying adhesive coatings using that die system, respectively. The material to be coated is fed into the die, and forced out through a line of orifices. A plurality of spaced beads of coating exits the line of orifices. This plurality of beads is coated directly onto the web as a series of stripes. The web is then drawn under tension after the beads are disposed on the web to shear the plurality of beads and merge the beads into a continuous wide sheet. Two of these multiple orifice dies may be sequentially oriented to make the tapes of the present invention.

Preferably, the coating method used results in good line or edge definition between the zones. The alignment between the knives or the slots preferably is adjusted to take into account the web speed and the viscosity of the coating solution.

The preferred viscosity of the top layer material(s) differs with the application or coating method. For example, for slot die coating, typically the top layer material(s) has a viscosity ranging from 0.005–20 Pa.sec. For extrusion coating the viscosity of the coated material typically ranges from 50–5000 Pa.sec and for knife-over-roll, the coated material's viscosity typically ranges from 0.1–50 Pa.sec. (Cohen, Edward and Gutoff, Edgar, eds., *Modern Coating and Drying Technology,* VCH Publishers, Inc., New York, 1992, page 18.)

For good uniformity and good line definition, preferably each top layer material has a viscosity which is relatively close to the viscosity of the adjacent zone material and preferably the coating thickness of each zone is substantially the same.

One suitable method for coating a patterned pavement marking tape with multiple colors incorporates the use of a roller. A slot die or a die having multiple slots or orifices (or other dispensing means) may be used to coat linear zones onto a roller. Coating composition(s) are fed through the slots or the orifices and applied onto a roller as a continuous linear zone of coating composition as the roller rotates. A base layer having protrusions on one surface (i.e., the front surface) is pulled through on a backing roller. The base layer is brought into contact with the roller. As the roller contacts the protrusions of the base layer, a discontinuous layer of each linear zone coating composition is applied to selected portions of the protrusions by conveying the base layer over a roller where the protrusions are pressed against a second roller having continuous linear zones of the coating composition.

Each linear zone may be comprised of a different composition having a variety of physical properties. For example, composition A may have better retroreflective properties, but be less aesthetically pleasing. Composition B may be less objectionable aesthetically, but lack the retroreflectance of composition A. Compositions A and B may be combined as desired to result in a pavement marking tape with superior retroreflection and appearance.

The width of each linear zone may be adjusted as desired. For example, one zone may be 0.5 cm wide and the adjacent zone may be 2.5 cm wide. A wide variety of widths and of coating patterns are achievable.

Optical elements, such as retroreflective glass or ceramic microspheres are then applied to the top of the base layer. The optical elements partially embed in the still liquid coating compositions which form the top layer. The optical elements may be flood coated, sprinkled, or cascaded onto the top of the base layer. The liquid coating composition is then solidified by application of heat, thereby locking the optical elements into the partially embedded position. See U.S. Pat. No. 4,988,541 (Hedblom), incorporated by reference herein. Each linear zone may have different optical elements.

EXAMPLES

The invention may be further explained by the following illustrative examples which are intended to be non-limiting. Unless otherwise indicated, all amounts are expressed in parts by weight.

Example 1

A base layer and top layer construction was made as follows.

To prepare the base layer, a roadside adhesive of polybutadiene resin in heptane as described in WO 95/08426, incorporated herein by reference, was coated on a polyester release liner at a wet coating weight of about 85 grains per 4 inch by 6 inch unit area (356 g/m$^2$). The adhesive was dried for about 4 minutes at approximately 200° F. (93° C.), yielding a dry weight of about 27 grains per 4 inch by 6 inch unit area (113 g/m$^2$). Next, a conformance layer of aluminum foil, about 75 microns (about 3 mils) in thickness was laminated to the roadside adhesive with the bottom conformance layer in contact with the roadside adhesive layer. Tie layer adhesive, also the polybutadiene resin in heptane, was then coated on the top side of the conformance layer to a wet weight of about 45 grains per 4 inch by 6 inch unit area (189 g/m$^2$). The resulting construction was then dried for about 2 minutes at approximately 200° F. (93° C.). A polyester available from Reemay, Inc./ Old Hickory, Tenn., was then laminated to the tie layer under pressure of approximately 50 pounds per square inch (345 kPa). This resulting base layer was then rolled up onto a cardboard core.

The top layer was comprised of two urethane compositions comprising the urethane composition disclosed in Example 1 of U.S. Pat. No. 5,077,117 were prepared; one with black pigment and one with white pigment with the following formulation in approximate weight percent:

| WHITE URETHANE | | BLACK URETHANE | |
|---|---|---|---|
| $TiO_2$ | 28% | Carbon Black | 17% |
| Tone 301, 310 | 30% | Tone 301, 310 | 34% |
| Desmodur N100 | 36% | Desmodur N100 | 43% |
| solvent | 6% | solvent | 6% |

Titanium Dioxide (CI 77891 Pigment White 6) is available from DuPont, Wilmington, Del. Carbon black (CI 77266 Pigment Black 7) is available from Ashland Oil, Carbon Black Division, Houston, Tex. Tone 0301 and 0310 are polycaprolactone triols, available from Union Carbide (Danbury, Conn.), and Desmodur N100 is biuret adduct of 1,6 hexamethylene, diisocyanate, available from Mobay Corporation, Coatings Division, Pittsburgh, Pa. Any suitable solvent may be used. Preferred solvents include methyl isobutyl ketone and 2,4-pentandione.

The two urethane compositions were supplied to a standard dual slot fed knife to simultaneously coat a single layer having two colors. The urethane compositions were supplied to the slots via a positive displacement pump. The coating thickness was controlled by adjusting the known amount of urethane composition flow from the positive displacement pump and the known web speed of the backing. Metal shims were installed in each slot to establish a ⅛ inch (0.32 cm) gap or smoothing land between the two different colored urethane compositions. The web speed was approximately 3 ft/min (0.91 m/min) and the pump ranged from about 8 to 16 cm$^3$/min.

The dual slot fed knife was adjusted inward toward the backup roll until the ⅛ inch (0.32 cm) gap between the color regions merged, joined, and connected to form a single layer coating.

The urethane compositions were applied at a wet thickness ranging between 2 and 10 mils (about 50 to about 250 microns) on the base layer with the preferred thickness of about 4 mil (100 microns) to control particle embedment. Retroreflective glass (index of refraction of 1.75) and ceramic (index of refraction of 1.76) microspheres were dropped onto the top layer to a coating of about 15 grains per 4 inch by 6 inch (63 grams/m$^2$). The coating thickness ranged from about 2 to about 8 mils (about 50 to about 200 microns), preferably about 4 mils (about 100 microns) to control particle embedment.

The resulting construction was then cured in a heated air floatation two-zone drying oven (Hirano Tecseed, Japan) for about 6 minutes at a temperature ranging from about 225 F. to 325 F. (107 to 163° C.) to yield a multicolored retroreflective pavement marking tape.

Example 2

A patterned pavement marking tape may be coated with multiple colors and/or compositions as follows.

The base layer from Stamark™ 380 pavement marking tape (available from 3M) may be coated with multiple compositions as a linear zone using a lower roll.

A slot die or a die having multiple slots or orifices is used to coat linear zones onto the protrusions of the pavement marking tape. Two or more coating compositions of desired width are fed through the die onto a lower roller. For example, the white urethane and the black urethane as described in Example 1, are fed through 3 slots or orifices and coated onto a lower roller to a coating thickness of 13 mils (325 microns). As the lower roller rotates, continuous linear zones corresponding to each coating composition form on the lower roller. The base layer on a backing roller is then brought into contact with the lower roller. As the lower roller contacts the protrusions of the base layer, a discontinuous layer of each zone is applied to the protrusions.

Retroreflective glass or ceramic microspheres are then applied to the top of the base layer. The microspheres partially embed in the still liquid coating compositions. The microspheres may be flood coated, sprinkled, or cascaded onto the top of the base sheet (i.e., the protrusion side). The liquid coating composition is then solidified by application of heat, thereby locking the microspheres into the partially embedded position. See U.S. Pat. No. 4,988,541 (Hedblom), incorporated by reference herein.

The resulting patterned pavement marking sheet has a continuous base layer with a top layer comprising a white conspicuity zone and two adjacent black contrast zones.

Various modifications and alterations of this invention will become apparent to those skilled in the art without departing from the scope and spirit of this invention.

What is claimed is:

1. A retroreflective pavement marking tape comprising a continuous base layer and a retroreflective top layer having a conspicuity zone and at least one contrast zone, said conspicuity zone and said contrast zone(s) being adjacent to each other and oriented substantially parallel to the longitudinal axis of said tape, said contrast zone being of a color that contrasts with said conspicuity zone color.

2. The pavement marking tape according to claim 1, wherein said base layer comprises a conformance layer, optionally a fibrous scrim, and optionally a tie layer.

3. The pavement marking tape according to claim 1, wherein said top layer has two contrast zones, said contrast zones being arranged on opposite sides of said top layer with said conspicuity zone being located therebetween.

4. The pavement marking tape according to claim 1, wherein said contrast zone(s) ranges from about 0.75 inch to about 2.0 inches (about 1.9 to about 5 cm) wide, and said conspicuity zone is at least about 2 inches (about 5 cm) wide.

5. The pavement marking tape according to claim 1, wherein said contrast zone(s) is black.

6. The pavement marking tape according to claim 1, wherein the color of said conspicuity zone is selected from the group consisting of yellow, orange, and white.

7. The pavement marking tape according to claim 1, wherein said conspicuity zone is retroreflective.

8. The pavement marking tape according to claim 1, wherein said contrast zone(s) and said conspicuity zone are both retroreflective.

9. The pavement marking tape according to claim 1, wherein said continuous base layer is substantially flat and has substantially no protrusions.

10. The pavement marking tape according to claim 1, wherein said tape is substantially flat.

11. The pavement marking tape according to claim 1, wherein said tape is patterned.

12. The pavement marking tape according to claim 1, wherein said top layer is comprised of material selected from the group consisting of urethane, ethylene/methacrylic acid, epoxy, vinyl, and mixtures thereof.

13. The pavement marking tape according to claim 1, wherein said top layer comprises at least one of optical elements and skid-resistant particles.

14. The pavement marking tape according to claim 1, wherein said top layer comprises pigment distributed substantially uniformly throughout.

15. The pavement marking tape according to claim 1, wherein skid-resistant particles protrude from said top layer in both said contrast zone and said conspicuity zone(s).

16. The pavement marking tape according to claim 1, wherein said conspicuity zone further comprises a plurality of narrower regions.

17. The pavement marking tape according to claim 1, wherein said contrast zone(s) further comprise(s) a plurality of narrower regions.

18. The pavement marking tape according to claim 1, wherein said tape is durable.

19. The pavement marking tape according to claim 1, wherein said tape is removable.

* * * * *